US011658390B2

(12) United States Patent
Baks et al.

(10) Patent No.: US 11,658,390 B2
(45) Date of Patent: May 23, 2023

(54) WIRELESS COMMUNICATIONS PACKAGE WITH INTEGRATED ANTENNA ARRAY

(71) Applicants: International Business Machines Corporation, Armonk, NY (US); Ericsson AB, Stockholm (SE)

(72) Inventors: Christian W. Baks, Pleasant Valley, NY (US); Daniel J. Friedman, Sleepy Hollow, NY (US); Xiaoxiong Gu, Scarsdale, NY (US); Duixian Liu, Scarsdale, NY (US); Alberto Valdes Garcia, Chappaqua, NY (US); Joakim Hallin, Askim (SE); Ola Ragnar Tageman, Gothenburg (SE)

(73) Assignees: International Business Machines Corporation, Armonk, NY (US); Ericsson AB, Stockholm (SE)

( * ) Notice: Subject to any disclaimer, the term of this patent is extended or adjusted under 35 U.S.C. 154(b) by 188 days.

(21) Appl. No.: 16/750,861

(22) Filed: Jan. 23, 2020

(65) Prior Publication Data

US 2020/0161744 A1 May 21, 2020

Related U.S. Application Data

(62) Division of application No. 15/368,600, filed on Dec. 3, 2016, now Pat. No. 10,594,019.

(51) Int. Cl.
*H01Q 1/22* (2006.01)
*H01Q 9/04* (2006.01)
(Continued)

(52) U.S. Cl.
CPC ..... *H01Q 1/2283* (2013.01); *H01Q 1/38* (2013.01); *H01Q 1/48* (2013.01); *H01Q 1/526* (2013.01);
(Continued)

(58) Field of Classification Search
CPC ..... H01Q 1/2283; H01Q 1/38; H01Q 1/48; H01Q 1/526; H01Q 1/243; H01Q 9/045;
(Continued)

(56) References Cited

U.S. PATENT DOCUMENTS 4,835,538 A 5/1989 McKenna et al.
5,043,738 A 8/1991 Shapiro et al.
(Continued)

FOREIGN PATENT DOCUMENTS

CN 101662076 A 3/2010
EP 2779308 A1 9/2014
(Continued)

OTHER PUBLICATIONS

Notice of Reasons for Refusal, issued by the JPO dated Apr. 2, 2021, for Japanese Patent Application No. 2017-230728, which is a counterpart application of U.S. Appl. No. 15/368,600 (now U.S. Pat. No. 10,594,019), to which the current application claims priority.
(Continued)

*Primary Examiner* — Awat M Salih
(74) *Attorney, Agent, or Firm* — Daniel Morris; Ryan, Mason & Lewis, LLP

(57) ABSTRACT

Antenna package structures are provided to implement wireless communications packages. For example, an antenna package includes multilayer package substrate, a planar antenna array, antenna feed lines, and resistive transmission lines. The planar antenna array includes an array of active antenna elements and dummy antenna elements surrounding the array of active antenna elements. Each active antenna element is coupled to a corresponding one of the antenna feed lines, and each dummy antenna element is coupled to a corresponding one of the resistive transmission lines. Each resistive transmission line extends through the multilayer
(Continued)

package substrate and is terminated in a same metallization layer of the multilayer package substrate.

11 Claims, 9 Drawing Sheets

(51) Int. Cl.
*H01Q 21/06* (2006.01)
*H01Q 1/38* (2006.01)
*H01Q 1/48* (2006.01)
*H01Q 1/52* (2006.01)
*H01Q 21/24* (2006.01)

(52) U.S. Cl.
CPC ..... *H01Q 9/045* (2013.01); *H01Q 9/0407* (2013.01); *H01Q 21/065* (2013.01); *H01Q 21/24* (2013.01)

(58) Field of Classification Search
CPC .... H01Q 9/0407; H01Q 21/065; H01Q 21/24; H01Q 21/061; H01Q 23/00; G01R 1/0408; G01R 1/0416; G01R 1/045; H01L 23/49822; H01L 23/49827; H01L 23/49833; H01L 23/66
See application file for complete search history.

(56) References Cited

U.S. PATENT DOCUMENTS 6,154,176 A * 11/2000 Fathy ..... H01Q 9/0414 343/846
6,239,762 B1 * 5/2001 Lier ..... H01Q 13/10 343/700 MS
6,594,893 B2 7/2003 Bailey et al.
6,696,930 B1 2/2004 Nahapetian et al.
7,372,408 B2 5/2008 Gaucher et al.
7,518,221 B2 4/2009 Gaucher et al.
7,675,465 B2 3/2010 Doan et al.
7,696,930 B2 4/2010 Akkermans et al.
8,269,671 B2 9/2012 Chen et al.
8,362,599 B2 1/2013 Kim
8,648,454 B2 2/2014 Liu et al.
8,970,435 B2 * 3/2015 Aboush ..... H01Q 9/0435 343/700 MS
8,988,299 B2 3/2015 Kam et al.
9,196,951 B2 * 11/2015 Baks ..... H01Q 1/2283
11,415,450 B2 * 8/2022 Waelde ..... H01Q 15/08
2005/0073460 A1 4/2005 Schmidt et al.
2005/0088260 A1 4/2005 Ajioka et al.
2006/0276157 A1 12/2006 Chen et al.
2008/0291115 A1 11/2008 Doan et al.
2009/0256752 A1 10/2009 Akkermans
2009/0322643 A1 12/2009 Choudhury
2010/0190464 A1 7/2010 Chen et al.
2010/0327068 A1 12/2010 Chen et al.
2011/0285606 A1 11/2011 De Graauw et al.
2012/0075154 A1 3/2012 Biglarbegian
2012/0212384 A1 8/2012 Kam et al.
2012/0235880 A1 9/2012 Kim et al.
2012/0262188 A1 10/2012 Nickel et al.
2012/0313818 A1 12/2012 Puzella et al.
2013/0099006 A1 4/2013 Hong et al.
2013/0141284 A1 6/2013 Jeong
2013/0189935 A1 7/2013 Nair
2014/0145883 A1 * 5/2014 Baks ..... H01L 23/66 343/700 MS
2014/0145884 A1 5/2014 Dang et al.
2016/0049723 A1 2/2016 Baks et al.
2017/0125895 A1 * 5/2017 Baks ..... H01Q 1/2291

FOREIGN PATENT DOCUMENTS

GB 2513334 A 10/2014
JP H0746033 A 2/1995
JP H11330847 A 11/1999
JP H11340729 A 12/1999
JP 2000114866 A 4/2000
JP 2003168920 A 6/2003
JP 2003309426 A 10/2003
JP 2005086603 A 3/2005
JP 2006514483 A 4/2006
JP 2011519517 A 7/2011
JP 2012521716 A 9/2012
JP 2013046291 A 3/2013
JP 2015211056 A 11/2015
WO WO2012151003 A2 11/2012
WO 2014178125 A1 11/2014

OTHER PUBLICATIONS

Search Report dated May 15, 2018 for counterpart GB Application No. GB1718932.5.
T. Seki et al., "Millimeter-Wave High-Efficiency Multilayer Parasitic Microstrip Antenna Array on Teflon Substrate," IEEE Transactions on Microwave Theory and Techniques, Jun. 2005, pp. 2101-2106, vol. 53, No. 6.
List of IBM Patents or Patent Applications Treated as Related.
German Office Action issued by the German Patent Office on Sep. 2, 2021 for German Patent Application No. 10 2017 218 497.3 which is a counterpart application of U.S. Appl. No. 15/368,600 (now U.S. Pat. No. 10,594,019), to which the current application claims priority.
English translation of German Office Action for German Patent Application No. 10 2017 218 4978.3.

* cited by examiner

400

500

WIRELESS COMMUNICATIONS PACKAGE WITH INTEGRATED ANTENNA ARRAY

TECHNICAL FIELD

This disclosure generally relates to wireless communications package structures and, in particular, to techniques for packaging antenna structures with semiconductor RFIC (radio frequency integrated circuit) chips to form compact integrated radio/wireless communications systems for millimeter wave (mm Wave) applications.

BACKGROUND

When constructing wireless communications package structures with integrated antennas, it is important to implement package designs that provide proper antenna characteristics (e.g., high efficiency, wide bandwidth, good radiation characteristics, etc.), while providing low cost and reliable package solutions. The integration process requires the use of high-precision fabrication technologies so that fine features can be implemented in the package structure. Conventional solutions are typically implemented using complex and costly packaging technologies, which are lossy and/or utilize high dielectric constant materials. For consumer applications, high performance package designs with integrated antennas are not typically required. However, for industrial applications (e.g., 5G cell tower applications), high performance antenna packages are needed and typically require large phased array antenna systems. The ability to design high performance packages with phased array antennas is not trivial for millimeter wave operating frequencies and higher. For example, conventional surface-wave suppressing methods in antenna designs cannot be used in phased array antenna packages as the additional structures used for suppressing surface waves occupy too much space, which is not desirable for compact designs. Moreover, other factors make it difficult and non-trivial to implement phased array antenna systems in a package environment

SUMMARY

Embodiments of the invention generally include antenna package structures with integrated antenna arrays. For example, in one embodiment of the invention, an antenna package comprises a multilayer package substrate and a package cover. The multilayer package substrate comprises a plurality of antenna ground planes, a plurality of antenna feed lines, and a plurality of resistive transmission lines. The package cover comprises a planar lid. The planar lid comprises a planar antenna array patterned on a first surface of the planar lid, wherein the planar antenna array comprises an array of active antenna elements and a plurality of dummy antenna elements surrounding the array of active antenna elements. The package cover is bonded to a first surface of the multilayer package substrate with the first surface of the planar lid facing the first surface of the multilayer package substrate, wherein each active antenna element on the first surface of the planar lid is aligned to a corresponding one of the antenna ground planes and a corresponding one of the antenna feed lines, and wherein each dummy antenna element on the first surface of the planar lid is aligned to a corresponding one of the antenna ground planes and a corresponding one of the resistive transmission lines. Each resistive transmission line extends through the multilayer package substrate and is terminated in a same metallization layer of the multilayer package substrate. The package cover is bonded to the multilayer package substrate with the first surface of the planar lid fixedly disposed at a distance from the first surface of the multilayer package substrate to provide an air space between the planar antenna array and the first surface of the multilayer package substrate.

In another embodiment of the invention, an antenna package comprises a multilayer package substrate comprising a plurality of laminated layers, wherein each laminated layer comprises a patterned metallization layer formed on an insulating layer. The multilayer package further comprises a planar antenna array, a plurality of antenna feed lines, and a plurality of resistive transmission lines. The planar antenna array comprises an array of active antenna elements and a plurality of dummy antenna elements surrounding the array of active antenna elements. Each active antenna element is coupled to a corresponding one of the antenna feed lines, and each dummy antenna element is coupled to a corresponding one of the resistive transmission lines. Each resistive transmission line extends through the multilayer package substrate and is terminated in a same metallization layer of the multilayer package substrate.

Another embodiment of the invention includes a package structure which comprises a modular package, and a connector package coupled to the modular package. The modular package comprises a multilayer package substrate. The multilayer package substrate comprises (i) a planar core layer comprising a core substrate, and first and second ground planes formed on first and second surfaces of the core substrate, (ii) a first interface layer bonded to the first ground plane of the core substrate, wherein the first interface layer comprises a plurality of laminated layers, each laminated layer comprising a patterned metallization layer formed on an insulating layer, and (iii) a second interface layer bonded to the second ground plane of the core substrate. The second interface layer comprises a plurality of laminated layers, each laminated layer comprising a patterned metallization layer formed on an insulating layer, wherein the second interface layer comprises a power plane, a ground plane, and signal lines formed on one or more patterned metallization layers of the second interface layer. The multilayer package substrate further comprises a plurality of antenna feed lines, which are routed through the first interface layer, the planar core layer, and the second interface layer. A RFIC chip is flip-chip mounted to the second interface layer, wherein each antenna feed line is connected to a corresponding antenna feed port of the RFIC chip. The connector package comprises a plurality of connectors disposed on a first surface of the connector package, and a plurality of feed lines routed through the connector package, wherein each feed line is routed from a second surface of the connector package to a corresponding one of the connectors disposed on the first surface of the connector package. The second surface of the connector package is coupled to the first interface layer of the modular package such that each antenna feed line of the modular package is coupled to a corresponding one of the feed lines of the connector package to provide connections between the antenna feed ports of the RFIC chip and the connectors of the connector package. The connectors of the connector package are configured to couple the package structure to at least one of (i) external test equipment to test the RFIC chip and characteristics of the antenna feed lines and (ii) and an external antenna array system that is controlled by the RFIC chip.

These and other embodiments of invention will be described in following detailed description of embodiments, which is to be read in conjunction with the accompanying drawings.

DETAILED DESCRIPTION

Embodiments of the invention will now be discussed in further detail with regard to wireless communications package structures and, in particular, to techniques for packaging antenna structures with semiconductor RFIC chips to form compact integrated radio/wireless communications systems with high-performance integrated antenna systems (e.g., phased array antenna system). It is to be understood that the various layers and/or components shown in the accompanying drawings are not drawn to scale, and that one or more layers and/or components of a type commonly used in constructing wireless communications packages with integrated antennas and RFIC chips may not be explicitly shown in a given drawing. This does not imply that the layers and/or components not explicitly shown are omitted from the actual package structures. Moreover, the same or similar reference numbers used throughout the drawings are used to denote the same or similar features, elements, or structures, and thus, a detailed explanation of the same or similar features, elements, or structures will not be repeated for each of the drawings.

Figure 1:
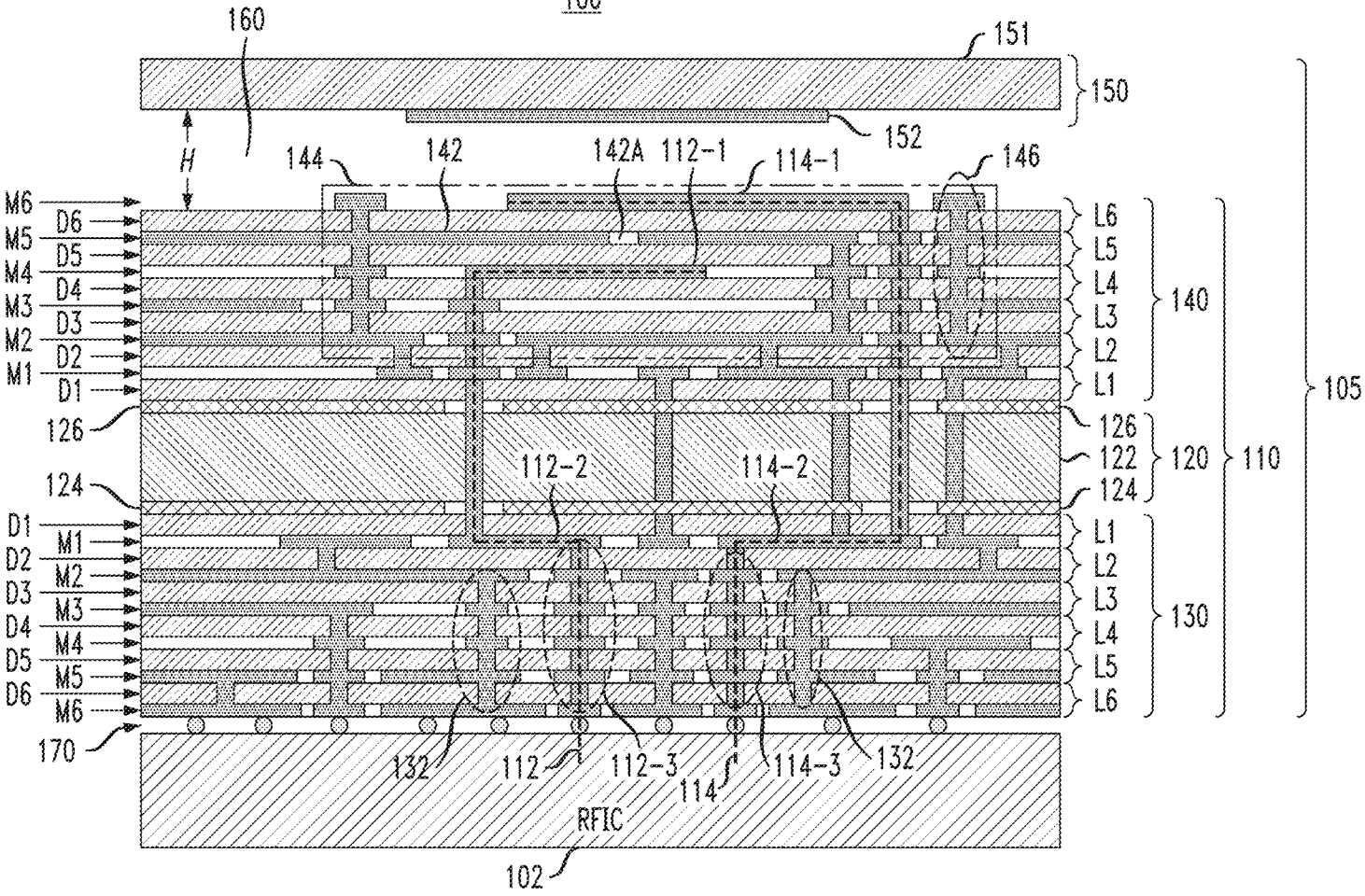
FIG. 1 schematically illustrates a wireless communications package according to an embodiment of the invention.

FIG. 1 is a schematic cross-sectional side view of a wireless communications package 100 according to an embodiment of the invention. The wireless communications package 100 comprises an RFIC chip 102, and an antenna-in-package 105 (or "antenna package") coupled to the RFIC chip 102. The antenna package 105 comprises a multilayer package substrate 110 comprising a central core layer 120, an interface layer 130, and an antenna layer 140. The antenna package 105 further comprises a package cover 150 which comprises a planar lid 151 having at least one planar antenna element 152 (e.g., patch antenna element) patterned on one side of the planar lid 151. The package cover 150 is mounted to a first side (e.g., top side) of the package substrate 110 with the planar antenna element 152 on the planar lid 151 facing the top side of the package substrate 110. The package lid 151 is disposed at a distance H from the top side of the package substrate 110 to form an embedded air cavity 160 which, as explained in further detail below, enables the implementation of a high-performance integrated antenna system having optimal antenna radiation characteristics for millimeter-wave operating frequencies and higher.

The RFIC chip 102 comprises a metallization pattern (not specifically shown) formed on an active surface (front side) of the RFIC chip 102, which metallization pattern includes a plurality of bonding/contact pads such as, for example, ground pads, DC power supply pads, input/output pads, control signal pads, associated wiring, etc., that are formed as part of a BEOL (back end of line) wiring structure of the RFIC chip 102. The RFIC chip 102 is electrically and mechanically connected to the antenna package 105 by flip-chip mounting the active (front side) surface of the RFIC chip 102 to a second side (e.g., bottom side) of the package substrate 110 using, for example, an array of solder ball controlled collapse chip connections (C4) 170, or other known techniques. Depending on the application, the RFIC chip 102 comprises RFIC circuitry and electronic components formed on the active side including, for example, a receiver, a transmitter or a transceiver circuit, and other active or passive circuit elements that are commonly used to implement wireless RFIC chips.

In one embodiment of the invention as shown in FIG. 1, the package substrate 110 comprises a multilayer structure that can be constructed using known fabrication technologies such as SLC (surface laminar circuit), HDI (high density interconnect), or other fabrication techniques, which enable the formation of organic-based multilayered circuit boards with high integration density. Using these circuit board fabrication techniques, the package substrate 110 can be formed from a stack of laminated layers comprising alternating layers of metallization and dielectric/insulator materials, wherein the metallization layers are separated from overlying and/or underlying metallization layers by a respective layer of dielectric/insulating material. The metallization layers can be formed of copper and the dielectric/insulating layers can be formed of an industry standard FR4 insulating material comprised of fiberglass epoxy material. Other types of materials can be used for the metallization and insulating layers. Moreover, these technologies enable the formation of small conductive vias (e.g., partial or buried vias between adjacent metallization layers) using laser ablation, photo imaging, or etching, for example, to enable the formation of high density wiring and interconnect structures within the package substrate 110.

In the embodiment of FIG. 1, the central core layer 120 provides a structurally sturdy layer upon which to build the interface layer 130 and the antenna layer 140 on opposite sides of the core layer 120. In one embodiment, the core layer 120 comprises a substrate layer 122 having a first ground plane 124 formed on a first side of the substrate layer 122, and a second ground plane 126 formed on a second side of the substrate layer 122. The substrate layer 122 can be formed of standard FR4 material, or other standard materials that are typically used to construct a standard printed circuit board. The substrate 122 can be formed with other materials having mechanical and electrical properties that are similar to FR4, providing a relatively rigid substrate structure that provides structural support for the package substrate 110.

The interface layer 130 comprises a plurality of laminated layers L1, L2, L3, L4, L5, L6, wherein each laminated layer L1, L2, L3, L4, L5, L6 comprises a respective patterned metallization layer M1, M2, M3, M4, M5, M6 formed on a respective dielectric/insulating layer D1, D2, D3, D4, D5, D6. Similarly, the antenna layer 140 comprises a plurality of laminated layers L1, L2, L3, L4, L5, L6, wherein each laminated layer L1, L2, L3, L4, L5, L6 comprises a respective patterned metallization layer M1, M2, M3, M4, M5, M6 formed on a respective dielectric/insulating layer D1, D2, D3, D4, D5, D6, which form various components in the antenna layer 140.

As noted above, in one embodiment, the laminated layers L1, L2, L3, L4, L5, L6 of the interface and antenna layers 130 and 140 can be formed using state of the art fabrication techniques such as SLC or similar technologies, which can meet the requisite tolerances and design rules needed for high-frequency applications such as millimeter-wave applications. With an SLC process, each of the laminated layers are separately formed with a patterned metallization layer, wherein the first layers L1 of the interface and antenna layers 130 and 140 are bonded to the core layer 120, and wherein the remaining laminated layers L2, L3, L4, L5 and L6 (of the respective interface and antenna layers 130 and 140) are sequentially bonded together using any suitable bonding technique, e.g., using an adhesive or epoxy material. As further shown in FIG. 1, conductive vias are formed through the core layer 120 and through the dielectric/insulating layers D1, D2, D3, D4, D5, D6 of the interface and antenna layers 130 and 140. The conductive vias that are formed through a given dielectric/insulating layer are connected to via pads that are patterned from the metallization layers disposed on each side of the given dielectric/insulating layer.

The various metallization layers M1, M2, M3, M4, M5, M6, 124 and 126 and vertical conductive vias are patterned and interconnected within and through the various layers (core layer 120, interface layer 130, and antenna layer 140) of the package substrate 110 to implement various features which are needed for a target wireless communications application. Such features include, for example, antenna feed lines, ground planes, RF shielding and isolation structures, power planes for routing supply power to the RFIC 102 (and other RFICs or chips that may be included in the wireless communications package 100), signal lines for routing IF (intermediate frequency) signals, LO (local oscillator) signals, other low frequency I/O (input/output) baseband signals, etc.

In particular, as shown in the example embodiment of FIG. 1, the package substrate 110 comprises a first antenna feed line (denoted by dashed line 112) and a second antenna feed line (denoted by dashed line 114), which are routed through the interface layer 130, the core layer 120, and the antenna layer 140. The first and second antenna feed lines 112 and 114 comprise a series of interconnected metallic traces and conductive vias which are part of the metallization and dielectric layers of the interface layer 130, the core layer 120, and the antenna layer 140 of the package substrate 110.

As further shown in FIG. 1, the metallization layer M5 of the antenna layer 140 is patterned to form an antenna ground plane 142 and a coupling aperture 142A (e.g., coupling slot) that is aligned to the patch antenna element 152 formed on the package lid 151. The first antenna feed line 112 comprises a horizontal stripline structure 112-1 which is patterned on the metallization layer M4 and aligned to the coupling aperture 142A of the antenna ground plane 142. In this embodiment, the metallization layers M2 and M5 of the antenna layer 140 serve as ground planes for the horizontal stripline structure 112-1, for example. The horizontal stripline structure 112-1 is configured to couple electromagnetic energy to and from the patch antenna element 152 through the coupling aperture 142A, thereby providing an aperture-coupled antenna configuration.

Similarly, the second antenna feed line 114 comprises a horizontal microstrip structure 114-1 which is patterned from the metallization layer M6 and aligned with the patch antenna element 152. In this embodiment, the metallization layer M5 of the antenna layer 140 serves as a ground plane for the horizontal microstrip structure 114-1, for example. The horizontal microstrip structure 114-1 is configured to couple electromagnetic energy to and from the patch antenna element 152, thereby providing an electromagnetically-coupled patch antenna configuration.

In the example embodiment of FIG. 1, the first and second antenna feed lines 112 and 114 are configured to enable polarization diversity (e.g., horizontal and vertical polarization) when transmitting and/or receiving of electromagnetic signals, as is understood by one of ordinary skill in the art. In particular, the first antenna feed line 112 enables a horizontal polarization mode of operation of the patch antenna element 152, and the second antenna feed line 114 enables a vertical polarization mode of operation of the patch antenna element 152. Moreover, while only one patch antenna element 152 and associated antenna feed lines 112 and 114 are shown in FIG. 1 for ease of illustration, for phased array antenna applications, the planar lid 151 will have an array of patch antenna elements, and the package substrate 110 will have a similar feed line configuration (pair of feed lines 112 and 114 for horizontal and vertical polarization, and ground plane 142 with coupling slot 142A) as shown in FIG. 1 for each patch antenna element in the array.

In one embodiment of the invention, the first and second antenna feed lines 112 and 114 (as well as all other antenna feed lines formed within the package substrate 110) are designed to have equalized lengths to optimize antenna operation. For example, for phased array implementations, forming all antenna feed lines within the package substrate 110 to have the same or substantially the same length facilitates phase adjustment of RF signals that are fed to the patch antenna elements of the antenna array, prevents phased array beam squint, reduces angle scan error, and effectively increases the bandwidth of operation of the antenna elements.

In the example embodiment of FIG. 1, the length of the vertical portions of the antenna feed lines 112 and 114 which vertically extend though interface layer 130, the core layer 120, and the antenna layer 140, are fixed in length based on the thickness of the various layers of the package substrate 110. However, depending on the horizontal/lateral position of the patch antenna elements of the antenna array relative to the corresponding antenna feed line ports of the RFIC chip 102, the lateral distance between the patch antenna elements and the RFIC chip 102 will vary. In this regard, to ensure that each antenna feed line has the same length (or substantially the same length) overall, in one embodiment of the invention, a lateral routing of the antenna feed lines within the multilayer package substrate 110 is implemented with transmission lines formed in the same metallization layer of the multilayer package substrate. For example, in the embodiment shown in FIG. 1, the lengths of the antenna feed lines 112 and 114 are adjusted in the first layer L1 of the interface layer 130 by extending or shortening the routing of the lateral portions of the antenna feed lines 112 and 114 patterned from the metallization layer M1 of the interface layer 130.

More specifically, in the embodiment of FIG. 1, horizontal portions 112-2 and 114-2 of the first and second antenna feed lines 112 and 114 are patterned from the first metallization layer M1 of the interface layer 130 to ensure that the first and second antenna feed lines 112 and 114 have equal lengths from the feed ports of the RFIC chip 102 to the horizontal feed portions 112-1 and 114-1 in the antenna layer 140. The lengths of the horizontal portions 112-2 and 114-2 of the first and second antenna feed lines 112 and 114 are either extended or shortened to compensate for the difference in the lateral and/or vertical position of the other portions of the antenna feed lines 112 and 114 which are routed through the interface layer 130, the core layer 120 and antenna layer 140. An example embodiment which illustrates such routing will be explained in further detail below with reference to FIGS. 2A and 2B.

The interface layer 130 comprises wiring to distribute power to the RFIC chip 102 and to route signals between two or more RFIC chips that are flip-chip mounted to the package substrate 110. For example, in one embodiment of the invention, the metallization layers M3 and M4 of the interface layer 130 serve as power planes to distribute power supply voltage to the RFIC chip 102 from an application board (see, e.g., FIG. 4) using horizontal traces that are patterned on the metallization layers M3 and M4, and vertical via structures that are formed through the layers L4, L5, and L6 to connect the power plane metallization to contact pads on the RFIC chip 102. In another embodiment, the metallization layer M1 of the antenna layer 140 can also be utilized as a power plane to distribute power supply voltage between components attached to the package substrate 110. Further, the metallization layer M5 of the interface layer 130 is patterned to form signal lines (e.g., microstrip transmission lines) for transmitting control signals, baseband signals, and other low frequency signals between an application board and the RFIC chip 102 (or between multiple RFIC chips attached to the package substrate 110). In this embodiment, the metallization layer M6 of the interface layer 130 can serve as a ground plane for the microstrip transmission lines of the metallization layer M5.

It is to be further noted that in the example embodiment of FIG. 1, each of the layers 120, 130 and 140 comprise ground planes that are used for purposes of providing shielding and to provide ground elements for microstrip or stripline transmission lines, for example, that are formed by horizontal traces. For example, the metallization layer M2 of the antenna layer 140, and the metallization layers 124 and 126 of the core layer 120, comprise ground planes that serve as RF shields to shield the RFIC chip 102 from exposure to incident electromagnetic radiation (EM) captured by the patch antennas.

Moreover, the ground planes M2 and M3 of the antenna layer 140, the ground planes 124 and 126 of the core layer 120, and the ground planes M2 and M6 of the interface layer 130, are configured to, e.g., (i) provide shielding between horizontal signal line traces formed in adjacent metallization layers, (ii) serve as ground planes for microstrip or stripline transmission lines, for example, that are formed by the horizontal signal line traces, and (iii) provide grounding for vertical shield structures 132 that are formed by a series of vertically connected grounded vias, which are formed through layers L3 to L6 between metallization layers M2 and M6), and which surround portions of the antenna feed lines (e.g., vertical portions 112-3 and 114-3) extending through the interface layer 130, for example. For very high frequency applications, the implementation of stripline transmission lines and ground shielding helps to reduce interference effects of other package components such as the power plane(s), low frequency control signal lines, and other transmission lines.

In the example embodiment of FIG. 1, the vertical portions 112-3 and 114-3 of the antenna feed lines 112 and 114 and the vertical shield structures 132 that surround the vertical portions 112-3 and 114-3 essentially form a transmission line structure that is similar to a coaxial transmission line, wherein the surrounding vertical shields 132 serve as an outer (shielding) conductor, and the vertical portions 112-3 and 114-3 serves as a center (signal) conductor. Coaxial transmission line configurations can be implemented for other vertical portions of the antenna feed lines 112 and 114 which extend through the core layer 120 and the antenna layer 140, as schematically illustrated in FIG. 1.

Moreover, metallization layer M6 of the interface layer 130 serves as a ground plane to isolate the package substrate 110 from the RFIC chip 102 for enhanced EM shielding. The metallization layer M6 of the interface layer 130 comprises via openings to provide contact ports for connections between the RFIC chip 102 and package feed lines, signal lines and power lines of the package substrate 110.

In addition, the antenna layer 140 comprises an isolation region 144 which is formed by a grounded vertical cavity wall 146 (which surrounds the horizontal feed portions 112-1 and 114-1 of the first and second antenna lines 112 and 114), and a lower ground plane formed on the metallization layer M2 of the antenna layer 140. In one embodiment, as shown in FIG. 1, the grounded vertical cavity wall 146 comprises a series of rectangular metallic rings (and other metallization features) which are patterned on the metallization layers M2 through M6 of the antenna layer 140, and which are interconnected with conductive vias that are formed in layers L3 through L6 of the antenna layer 140. The isolation region 144 serves to improve the radiation efficiency of the patch antenna 152, and reduces EM coupling between adjacent patch antenna structures that may be formed on the bottom of the package lid 151 to implement an antenna array.

Figure 2A:
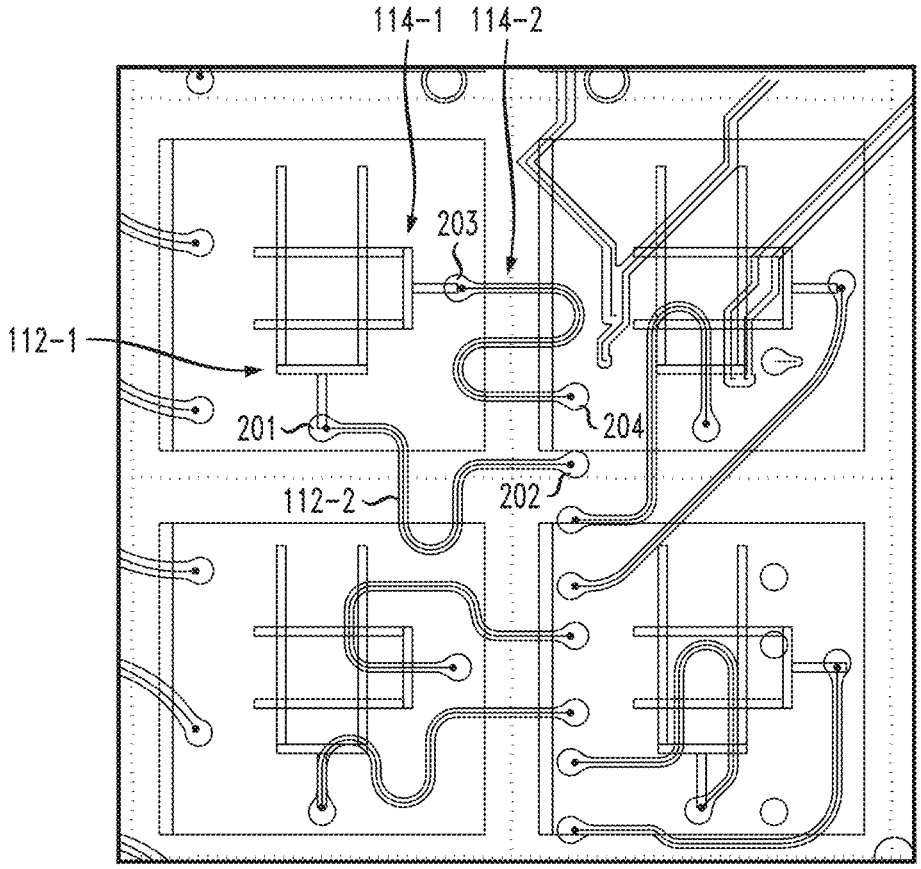
FIGS. 2A and 2B schematically illustrate a method for adjusting lengths of antenna feed lines in a package structure to provide equalized length antenna feed lines, according to an embodiment of the invention.
Figure 2B:
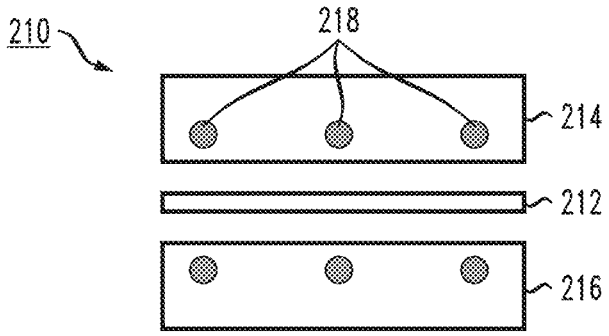

FIGS. 2A and 2B schematically illustrate a method for adjusting lengths of antenna feed lines in a package structure to provide equalized length antenna feed lines, according to an embodiment of the invention. In particular, FIG. 2A illustrates an example embodiment of a superimposed layout pattern 200 of the horizontal feed line portions 112-1 and 114-1 of the antenna feed lines 112 and 114, which electromagnetically couple RF energy to and from the patch antenna element 152, as well as the horizontal feed line portions 112-2 and 114-2, which are formed on the metallization layer M1 of the interface layer 130 to adjust the lengths of the antenna feed lines 112 and 114.

As shown in FIG. 2A, the horizontal feed line portions 112-1 and 114-1 comprise U-shaped (or fork-shaped) structures that are configured using known techniques to electromagnetically couple RF energy to and from a planar patch antenna element. As further shown in FIG. 2A, the horizontal feed line portions 112-2 and 114-2, which are formed on the metallization layer M1 of the interface layer 130, comprise meandering layout patterns with different lengths to allow equalization of the overall lengths of the antenna feed lines 112 and 114. In one embodiment of the invention, the horizontal feed line portions 112-2 and 114-2 are formed using grounded coplanar waveguide (CPW) structures, as shown in FIG. 2B, to minimize or prevent coupling between the horizontal feed line portions 112-2 and 114-2, as well as portions of other antenna feed line structures that are formed on the metallization layer M1.

In particular, FIG. 2B illustrates a grounded CPW structure 210 which comprises a signal line 212 disposed between ground planes 214 and 216. In the example embodiment of FIGS. 1 and 2A, the signal lines 212 and ground planes 214 and 216 that form the horizontal feed line portions 112-2 and 114-2 are patterned from the metallization layer M1 of the interface layer 130. As further shown in FIG. 2B, a series of grounding vias 218 connect the ground planes 214 and 216 to underlying ground layers. For example, in the embodiment of FIG. 1, the grounding vias 218 comprises conductive vias that are formed in the dielectric layer D2 of layer L2 of the interface layer 130 to connect the ground planes 214 and 216 (in metallization layer M1) to the underlying ground plane of the metallization layer M2 of the second layer L2 of the interface layer 130.

As further shown in FIG. 2A, the horizontal feed line portion 112-2 is routed between routing points 201 and 202, and the horizontal feed line portion 114-2 is routed between routing points 203 and 204. The routing point 201 represents the vertical portion of the antenna feed line 112 which extends from layer L4 of the antenna layer 140 to layer L1 of the interface layer 130. The routing point 202 represents the vertical portion of the antenna feed line 112 (e.g., portion 112-3, FIG. 1) which extends from layer L1 of the interface layer 130 to layer L6 of the interface layer 130. The routing point 203 represents the vertical portion of the antenna feed line 114 which extends from layer L6 of the antenna layer 140 to layer L1 of the interface layer 130. The routing point 204 represents the vertical portion of the antenna feed line 114 (e.g., portion 114-3, FIG. 1) which extends from layer L1 of the interface layer 130 to layer L6 of the interface layer 130. With this configuration, the antenna impedances for the horizontal and vertical feed portions of the antenna feed lines 112 and 114 are tuned to a target characteristic impedance $Z_O$ (e.g., 50 Ohms) before the routing points 201, 202, 203, and 204. As such, extending or shortening the lengths of the horizontal feed line portions 112-2 and 114-2*f* that are patterned from the metallization layer M1 of the first layer L1 of the interface layer 130 will not affect the impedance matching of the patch antenna 152.

Figure 3A:
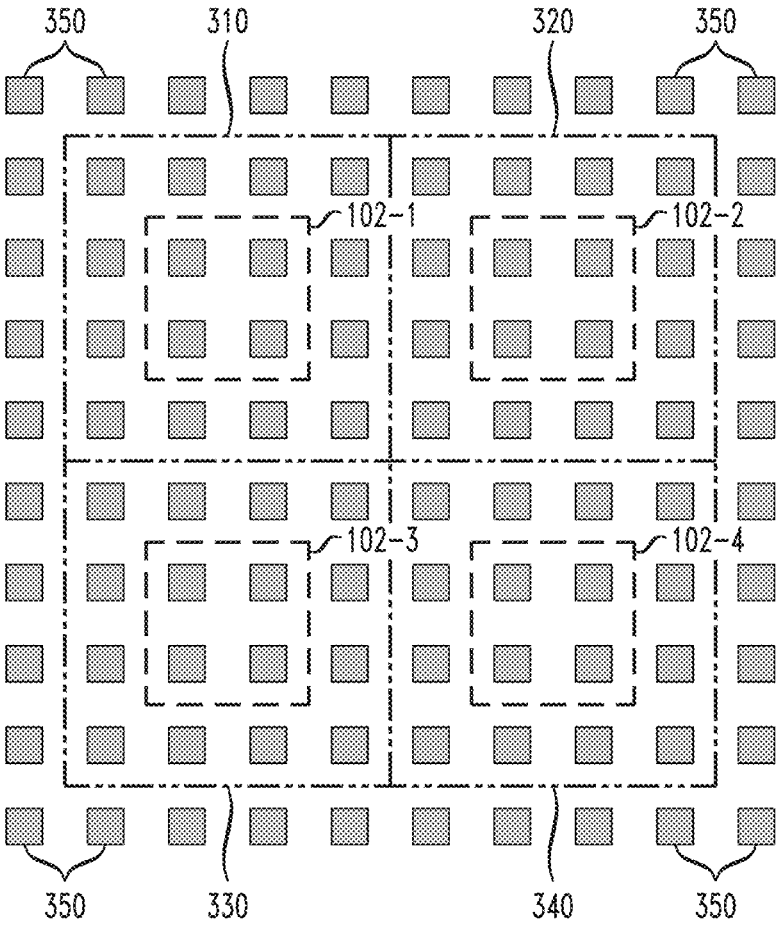
FIGS. 3A and 3B schematically illustrate a phased array antenna configuration which can be implemented in a wireless communications package, according to an embodiment of the invention.
Figure 3B:
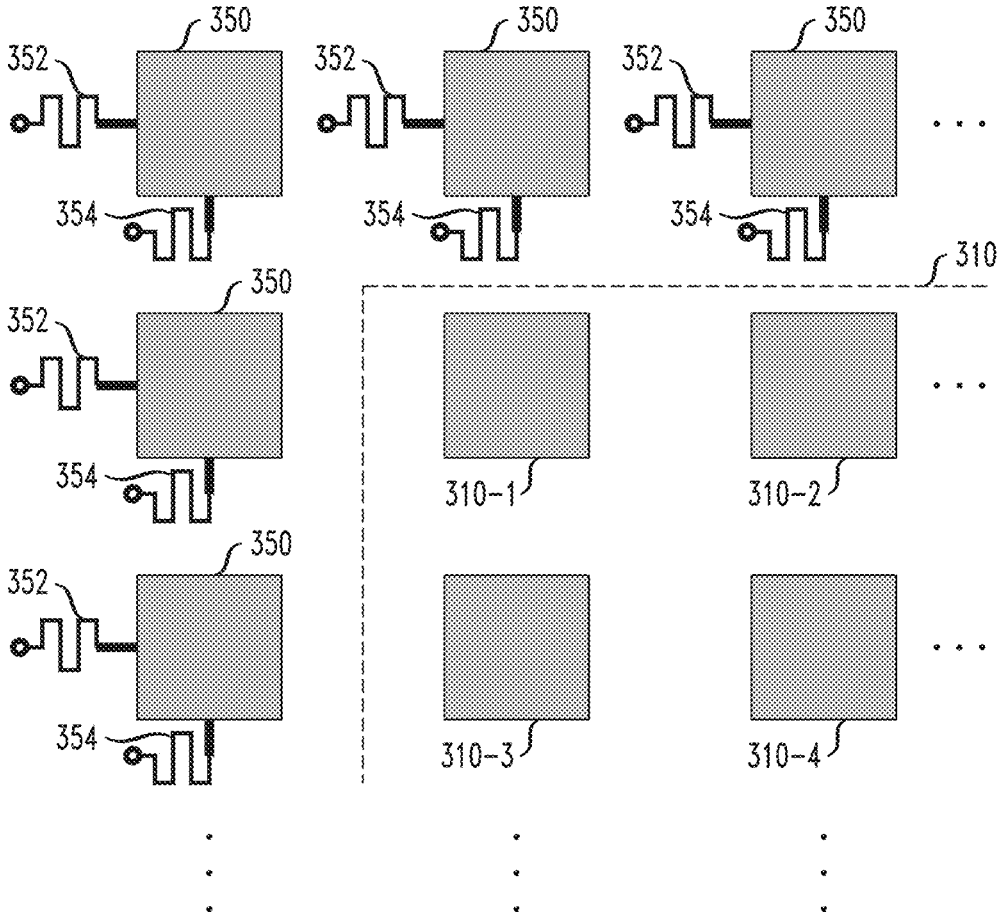

For ease of illustration, the exemplary wireless communications package 100 of FIG. 1 illustrates one patch antenna element 152 and corresponding antenna feedlines 112 and 114 which enable a dual polarization mode of operation of the patch antenna element 152. However, as noted above, in other embodiments of the invention, a wireless communications package is fabricated with an array of patch antenna elements and associated antenna feedlines to implement a phased array antenna system. For example, FIGS. 3A and 3B schematically illustrate a phased array antenna configuration which can be implemented in a wireless communications package according to an embodiment of the invention. In particular, FIG. 3A schematically illustrates a plan view of a phased array antenna configuration 300 comprising an array of active patch antenna elements divided into four (4) sub-arrays (or quadrants) 310, 320, 330 and 340 of active patch antenna elements, wherein each sub-array comprises a 4×4 array of active patch antenna elements.

The phased array antenna configuration 300 further comprises a plurality of dummy patch elements 350 disposed around an outer perimeter of the array of active patch antenna elements. The dummy patch elements 350 serve to enhance the radiation properties of the active patch elements of the phased array antenna configuration 300, as is understood by one of ordinary skill in the art. For example, the placement of the dummy patch elements 350 around the perimeter of the array reduces any adverse effects that the package edge and application environment would have on the radiation properties of the antenna array. As a result, the dummy patch elements 350 allows the active patch elements to have similar radiation patterns.

As further shown in FIG. 3A, in one embodiment of the invention, a plurality of RFIC chips 102-1, 102-2, 102-3, and 102-4 (shown in phantom as dashed lines) can be implemented in a wireless communications package, wherein each RFIC chip 102-1, 102-2, 102-3, and 102-4 controls operation of a respective one of the sub-arrays of patch antenna elements 310, 320, 330 and 340. In this embodiment, the RFIC chips 102-1, 102-2, 102-3, and 102-4 would be flip-chip bonded to a package substrate (e.g., package substrate 110, FIG. 1) and communicate with each other over control lines formed within an interface layer (e.g., interface layer 130, FIG. 1) to coordinate operation of the phased array antenna system 300.

In particular, in the example embodiment of FIG. 1, the array of active patch antenna elements 310, 320, 330, 340 shown in FIG. 3A would be formed on the bottom side of the package lid 151. Each active patch antenna element would be fed by an associated pair of antenna feed lines (similar to the antenna feed lines 112 and 114 shown in FIG. 1) to support horizontal and vertical polarization modes, and using the coupling structures and methods (e.g., ground plane 142 and coupling aperture 142A) as shown in FIG. 1. In this regard, 16 pairs of antenna feed lines would be routed through the package substrate 110 from the RFIC chip 102-1 to corresponding patch antenna elements of the sub-array 310, 16 pairs of antenna feed lines would be routed through the package substrate 110 from the RFIC chip 102-2 to corresponding patch antenna elements of the sub-array 320, 16 pairs of antenna feed lines would be routed through the package substrate 110 from the RFIC chip 102-3 to corresponding patch antenna elements of the sub-array 330, and 16 pairs of antenna feed lines would be routed through the package substrate 110 from the RFIC chip 102-4 to corresponding patch antenna elements of the sub-array 340. In addition, each RFIC chip 102-1, 102-2, 102-3, and 102-4 would comprise a 16-element dual polarized phased array transmit/receive (Tx/Rx) system to control operation of the respective sub-arrays 310, 320, 330, and 340 of patch antenna elements.

FIG. 3A is merely an example embodiment of a phased array antenna configuration which can be implemented using wireless communications package structures according to embodiments of the invention. One of ordinary skill in the art can readily envision various other types of phased array antenna configurations that can be implemented using packaging structures and methods as discussed herein.

To further optimize the radiation characteristics of the phased array antenna system, the dummy patch elements 350 can be terminated with resistive transmission lines, as schematically illustrated in FIG. 3B. In particular, FIG. 3B illustrates a portion of the phased array antenna system 300 of FIG. 3A (e.g., active patch antenna elements 310-1, 310-2, 310-3, 310-4 of sub-array 310, and adjacent dummy patch elements 350) where each dummy patch element 350 is schematically illustrated as being terminated with a first resistive transmission line 352 for the horizontal polarization mode, and a second resistive transmission line 354 for the vertical polarization mode. The first and second resistive transmission lines 352 and 354 enable the termination of dual polarized radiation incident on the dummy antenna elements 350.

In one embodiment, the resistive transmission lines 352 and 354 are implemented using antenna feed line structures similar to the antenna feed lines 112 and 114 shown in FIG. 1 for the horizontal and vertical polarization modes, as well as the coupling methods (e.g., ground plane 142 and coupling aperture 142A) to couple end portions of the resistive transmission lines 352 and 354 to an associated dummy patch element 350 formed on the package lid 151. However, instead of connecting the ends of the resistive transmission lines 352 and 354 to horizontal and vertical polarization antenna feed ports of an RFIC chip, the end portions of the resistive transmission lines 352 and 354 are laterally routed and terminated (grounded), for example, in the metallization layer M5 of layer L5 of the interface layer 130. In this regard, the end portions of the resistive transmission lines 352 and 354 can be fabricated as long folded microstrip transmission lines that are patterned in the metallization layer M5 and connected (terminated) to a ground plane in the interface layer 130.

The resistive transmission lines 352 and 354 can be fabricated to have a target characteristic impedance (e.g., $Z_O$=50 Ohms) which is sufficient to terminate the dummy patch elements for the given application. The characteristic impedance, $Z_O$, of the resistive transmission lines 352 and 354 could be engineered to achieve a particular effect on the radiation pattern of the antenna array, or to obtain a particular frequency response, etc. The lateral portions of the resistive transmission lines 352 and 354, which are patterned in the metallization layer M5 of the interface layer 130, are formed with a length that is sufficient to provide a transmission line loss that is electrically equivalent to a connecting a resistor of $Z_O$ Ohms to the feed ports of a dummy patch element.

Figure 4A:
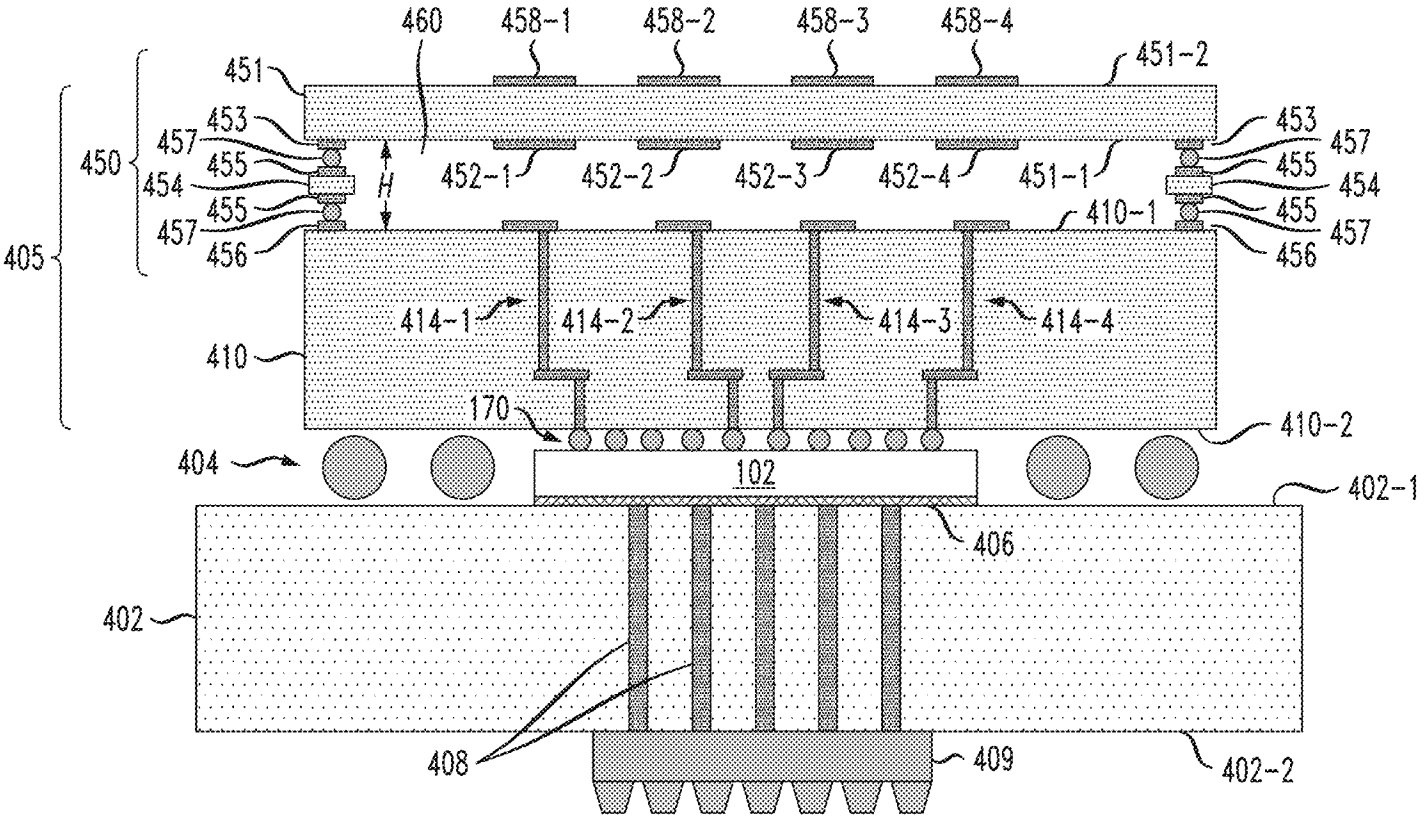
FIGS. 4A and 4B schematically illustrate a wireless communications package according to another embodiment of the invention.
Figure 4B:
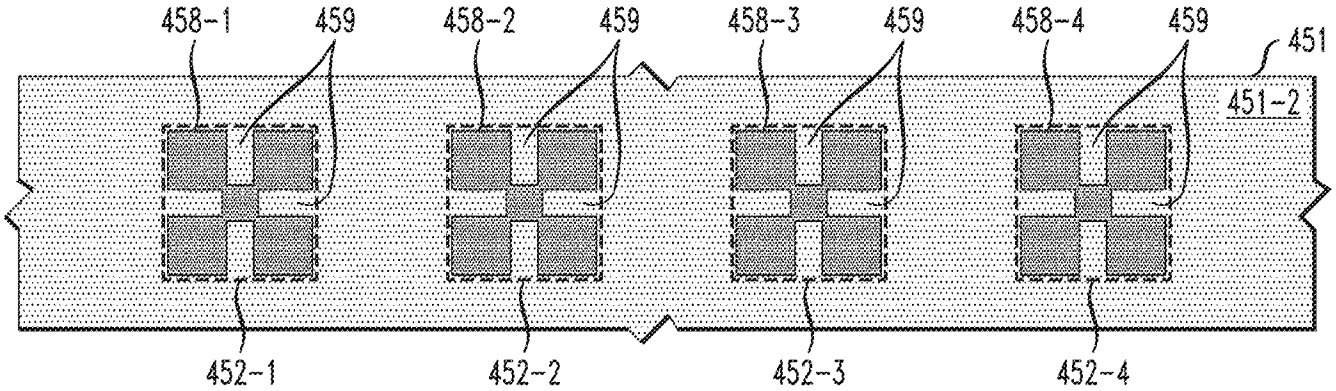

FIGS. 4A and 4B schematically illustrate a wireless communications package according to another embodiment of the invention. More specifically, FIG. 4A is a schematic cross-sectional side view of a wireless communications package 400 comprising an antenna package 405 and RFIC chip 102, which is electrically and mechanically connected to application board 402 using, for example, an array of BGA connections 404 or other similar techniques. The BGA connections 404 are formed between bonding/contact pads and wiring patterns of a metallization layer (e.g., metallization layer M6 of layer L6 of the interface layer 130, FIG. 1) on a bottom side 410-2 of the antenna package 405 and corresponding bonding/contact pads and wiring patterns of a metallization layer on a first (top) side 402-1 of the application board 402.

In addition, a layer of thermal interface material 406 is utilized to thermally couple the non-active (backside) surface of the RFIC chip 102 to a region of the application board 402 that is aligned to a plurality of metallic thermal vias 408 which extend through the application board 402 from the first side 402-1 to a second (bottom) side 402-2 of the application board 402. The layer of thermal interface material 406 serves to transfer heat from the RFIC chip 102 to the thermal vias 408, wherein the thermal vias 408 transfer the heat to a heat sink 409 mounted to the bottom side 402-2 of the application board 402, which dissipates the heat generated by the RFIC chip 102. Other heat sinking techniques may be implemented. It is to be understood that the package structure 100 shown in FIG. 1 could be mounted to an application board using the techniques shown in FIG. 4A.

The antenna package 405 comprises a package substrate 410 and a package cover 450. The package substrate 410 comprises a plurality of antenna feed lines 414-1, 414-2, 414-3, and 414-4, wherein each antenna feed line comprises a series of interconnected metallic traces and conductive vias that are formed are part of various alternating metallization and insulating/dielectric layers of the package substrate 410. While the package substrate 410 is generically illustrated in FIG. 4A, in one embodiment of the invention, the package substrate 410 comprises a multilayer build-up structure comprising an interface layer, a core layer and antenna layer, similar to package substrate 110 shown in the embodiment of FIG. 1. For example, in the example embodiment of FIG. 4A, the plurality of antenna feed lines 414-1, 414-2, 414-3, and 414-4 could be implemented similar to the antenna feed line 114 (shown in FIG. 1) to enable a vertical polarization mode of operation of the patch antenna elements formed on the package cover 450.

In particular, the package cover 450 shown in FIG. 4A comprises a planar lid 451 with an array of planar patch antenna elements 452-1, 452-2, 452-3, and 452-4 formed on a first (bottom) side 451-1 of the planar lid 451. The patch antenna elements 452-1, 452-2, 452-3, and 452-4 are disposed on the bottom side 451-1 of the planar lid 451 in alignment with end portions of the antenna feed lines 414-1, 414-2, 414-3, and 414-4, respectively, which are patterned on the top side 410-1 of the package substrate 410. In the embodiment shown in FIG. 4A, while only four patch antenna elements are shown for ease of illustration, the array of planar antenna elements may comprise any number of patch antenna elements, e.g., 4×4 array of 16 active patch antenna elements, or an 8×8 array of 64 active patch antenna elements (e.g., FIG. 3A), with dummy patch elements. Moreover, while only one RFIC chip 102 is shown in FIG. 4A, a plurality of RFIC chips can be flip chip mounted to the bottom side 410-2 of the package substrate 410, to control different sub-arrays of patch antenna elements of the antenna array formed on the package lid 451, as discussed above with reference to the example embodiment of FIG. 3A.

As further shown in FIG. 4A, the package lid 451 comprises a series of bonding pads 453 formed around a perimeter region on the bottom surface 451-1 of the planar lid 451. In addition, the package cover 450 comprises a separate rectangular frame structure 454 with a series of bonding pads 455 formed on the both sides thereof. Further, a series of boding pads 456 are formed around a perimeter region on the top surface 410-1 of the package substrate 410. A plurality of micro solder balls 457 (e.g., 50 um solder balls) are used to bond the frame structure 454 to the planar lid 451 and to the package substrate 410 during a solder reflow process, thereby forming a fixed package cover 450 which provides an embedded air cavity 460 of height H between the package lid 451 and the package substrate 410.

In one embodiment of the invention, planar lid 451 is formed from a planar substrate, e.g., an organic buildup substrate, a printed circuit board laminate, a ceramic substrate, or some other type of substrate that is suitable for the given application. The planar lid comprises a metallization layer one side thereof (e.g., bottom side 451-2) which is patterned to form the array of antenna elements (e.g., 452-1, 452-2, 452-3, 452-4) and bonding pads 453. In one embodiment, the planar lid 451 is formed with a thickness in a range of about 0.4 mm to about 2.0 mm.

The frame structure 454 can be fabricated from a separate substrate having copper metallization on both sides thereof. In one example embodiment, the substrate (forming the frame structure 454) can have a thickness of about 240 microns, for example, although the thickness of the substrate can vary depending on the target height H of the embedded air cavity 460, which desired for the given application. The copper metallization on both sides of the substrate can be patterned to form the bonding pads 455. A central region of the substrate is then milled away to form the rectangular-shaped frame structure 454, having a footprint that corresponds to the peripheral surface footprint of the planar lid 451.

In one embodiment of the invention, the package cover 450 shown in FIG. 4A can be bonded to the package substrate 410 using a solder reflow process. With this process, the solder balls 457 may be formed on the bonding pads 453 of the planar lid 451 and on the bonding pads 456 of the package substrate 410 prior to a bonding process. The frame structure 454 is placed between the planar lid 451 and the package substrate 410 with the solder balls 457 of the planar lid 451 and the package substrate 410 aligned to, and in contact with corresponding ones of the bonding pads 455 on the upper and lower sides of the frame structure 454. A solder reflow process is then performed to melt the solder balls 457 and, thus, bond the package cover 450 to the package substrate 410. In this bonding process, the solder reflow process ensures self-alignment of the patch antenna elements 452-1, 452-2, 452-3, and 452-4 with the respective end portions of the antenna feed lines 414-1, 414-2, 414-3 and 414-4 on the top surface 410-1 of the package substrate 410.

The embedded air cavity 460 provides a low dielectric constant medium, i.e., air with a dielectric constant≅1, between the patch antenna elements and an antenna ground plane (e.g., ground plane 142, FIG. 1) of the package substrate 410. In one embodiment of the invention, the height H of the air cavity 460 (and 160, in FIG. 1) is about 400 microns, and more generally, in a range of about 50 microns to about 2000 microns, depending on the operating frequency and other factors. The embedded air cavity 460 provides a low dielectric constant medium which serves to suppress or eliminate dominant surface waves that would otherwise exist with conventional patch antenna array designs in which the patch antenna elements and the ground plane are formed on opposing sides of a physical substrate made of dielectric or insulating material.

Indeed, in conventional patch antenna array designs, the substrate can be formed with dielectric/insulating material having a dielectric constant in excess of three, which can result in the creation of dominant surface waves that flow along the substrate surface between neighboring patch elements in the antenna array. These surfaces waves can produce currents at the edges, which, in turn, results in unwanted radiation that can adversely affect and disrupt the desired radiation pattern of the patch elements. Moreover, the surface waves can cause strong mutual coupling between the patch antenna elements in the antenna array, which adversely leads to significant shifts in the input impedance and radiation patterns.

In the embodiment of FIG. 4A (and FIG. 1), the embedded air cavity 460 between the antenna ground plane and the patch antenna array is an effective wave suppression technique that serves to eliminate dominant surface waves and thereby, enhances the radiation efficiency and radiation beam shape of the patch antenna array. While the planar lid 451 on which the planar antenna elements are formed may result in some mutual coupling between the antenna elements due to surface waves that flow on the surface 451-1 of the planar lid 451, such surface waves are insubstantial and have minimal, if no, adverse effect on the radiation efficiency and desired radiation patterns of the phased array antenna system.

As such, the embedded air cavity 460 eliminates the need to implement additional surface wave suppression structures that would otherwise occupy too much area and increase the footprint of the patch antenna array. To minimize any adverse effect that the planar lid 451 may have on the radiation efficiency and radiation patterns of the phased array antenna system, the planar lid 451 is formed as thin as possible and with materials having a low dielectric constant. Moreover, while low dielectric constant materials such as foam and Teflon may be considered (as an alternative to an embedded air cavity 460), these materials cannot bear the high temperatures and pressures that are encountered during various stages of the package fabrication process (e.g., BGA bonding, etc.).

Depending on the size of the integrated phased array antenna system, the area of the package cover 450 can be relatively large, which may result in sagging or bowing of the planar lid 451 on which the planar antenna elements 452-1, 452-2, 452-3, and 452-4 are formed. In one embodiment of the invention, as shown in FIGS. 4A and 4B, metallic support structures 458-1, 458-2, 458-3, and 458-4 are formed on a second side 451-2 (top side) of the planar lid 451 to prevent warpage or sagging of the planar lid 451. In one embodiment of the invention, the metallic support structures 458-1, 458-2, 458-3, and 458-4 have a similar footprint and layout as the array of planar patch antenna elements 452-1, 452-2, 452-3, and 452-4. For example, as depicted in FIG. 4A, the metallic support structures 458-1, 458-2, 458-3, and 458-4 are aligned with the respective patch antenna elements 452-1, 452-2, 452-3, and 452-4 on opposing sides 451-1 and 451-2 of the planar lid 451.

The formation of the metallic support structures 458-1, 458-2, 458-3, and 458-4 and the respective patch antenna elements 452-1, 452-2, 452-3, and 452-4 on opposing sides 451-2 and 451-1 of the planar lid 451 serves to improve manufacturability and prevent or minimize warpage during manufacture of the package cover, and to add structural integrity to the planar lid 451 to prevent sagging during and after construction of the wireless communications package. In particular, during manufacturing of the planar lid 451, the copper loading on both sides of the planar lid 451 serves to prevent warpage due to the thermal expansion and contraction of the copper.

In particular, if copper metallization is formed on one side of a relatively large and thin planar lid 451, the forces applied to the one side of the planar lid 451 due to the thermal expansion and contraction of the copper metallization could result in warpage of the planar lid 451. On the other hand, by having similar metallization patterns on both sides of the planar lid 451, similar forces are exerted by the thermal expansion and contraction of the copper metallization on both sides of the planar lid 451, which ensures that the planar lid 451 remains flat. The percentage of copper loading on both sides of the planar lid 451 should be sufficient to ensure flatness of the planar lid 451.

While the metallic support structures 458-1, 458-2, 458-3, and 458-4 on the top side 451-2 of the planar lid 451 are useful to prevent warpage and sagging, the metallic support structures 458-1, 458-2, 458-3, and 458-4 should be deigned in a way that minimizes or otherwise does not have any adverse effect on the radiation properties of the patch antenna elements 452-1, 452-2, 452-3, and 452-4. FIG. 4B is a schematic plan view of a portion of the upper surface 451-2 of the package lid 451 showing an exemplary pattern which can be implemented for the metallic structures 458-1, 458-2, 458-3, and 458-4 to prevent warping or sagging of the antenna package cover, while minimizing any adverse effects on the radiation characteristics of the antenna array, according to an embodiment of the invention.

As shown in FIG. 4B, each of the metallic structures 458-1, 458-2, 458-3, and 458-4 has a "leaf-shaped" pattern that is similar in appearance to a square-shaped "four leaf clover". More specifically, the metallic structures 458-1, 458-2, 458-3, and 458-4 are essentially rectangular-shaped patches having an outer perimeter footprint that is the same as, and aligned to, the underlying patch antenna elements 452-1, 452-2, 452-3, and 452-4 (shown as dashed outlines in FIG. 4B), with a plurality of etched slots 459. The etched slots 459 are provided to minimize any effect that the metallic structures 458-1, 458-2, 458-3, and 458-4 may have on the radiation properties of the underlying patch antenna elements 452-1, 452-2, 452-3, and 452-4, while providing necessary structural support to prevent warpage and sagging of the planar lid 451. While the size and spacing of the slots 459 does have some effect on the tuning characteristics of the patch antenna elements 452-1, 452-2, 452-3, and 452-4, other structural parameters of the antenna structures can be adjusted to obtain desired radiation characteristics when metallic support structures (e.g., metallic structures 458-1, 458-2, 458-3, and 458-4) are implemented.

The multilayer build-up structures and methods as discussed herein for fabricating antenna package structures (e.g., with separate interface, core and antenna layers) provide support for modular designs that allow a modular package structure (with a standard structural framework) to be readily interfaced with, e.g., a connector layer or different types of antenna layers, etc. This concept of modularity is schematically illustrated in FIG. 5.

Figure 5:
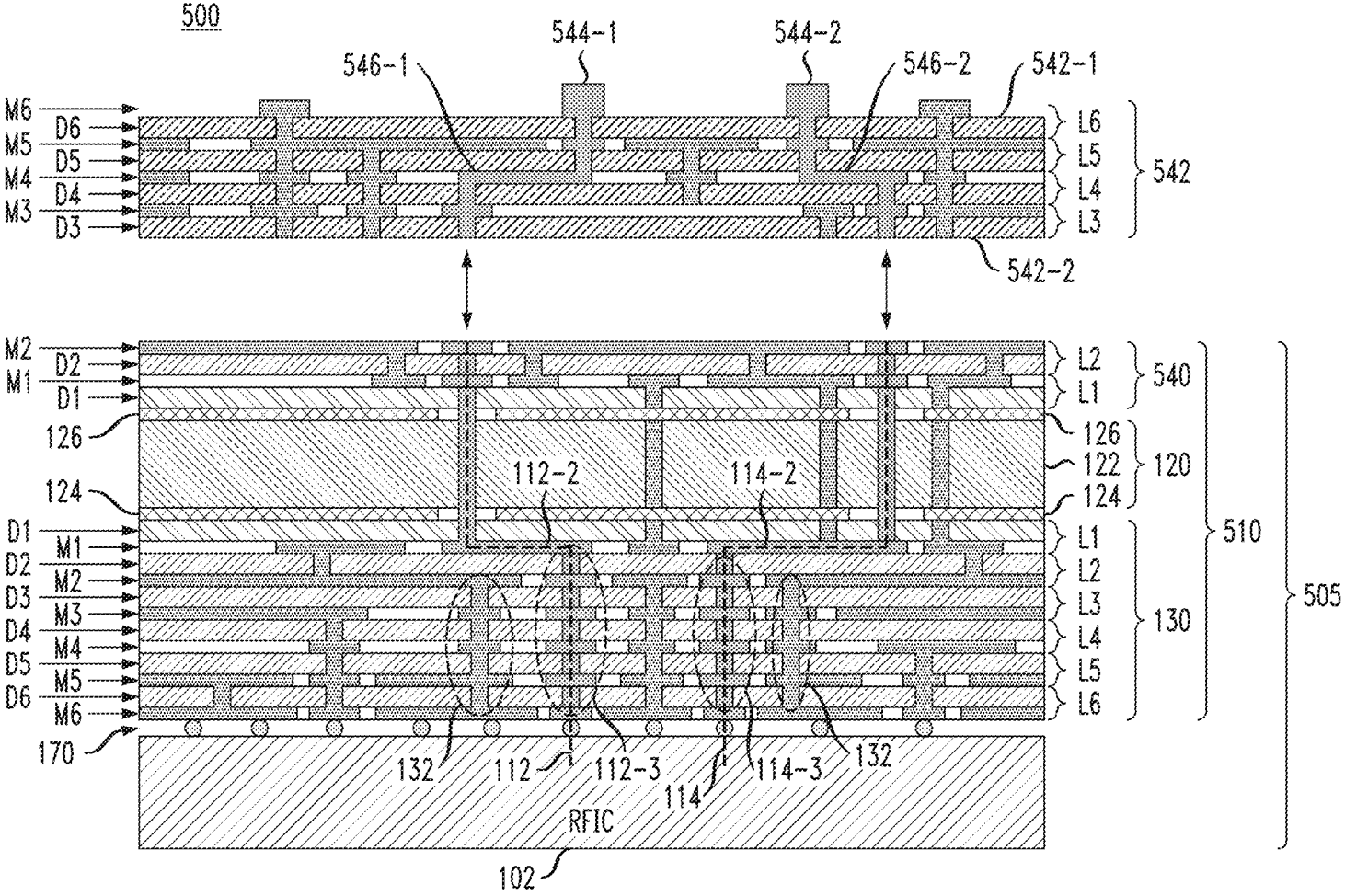
FIG. 5 schematically illustrates a process for building a connectorized wireless communications package structure by interfacing a connector package and a modular package, according to an embodiment of the invention.

In particular, FIG. 5 schematically illustrates a process for building a connectorized wireless communications package structure 500 by interfacing a connector package 542 and a modular package structure 505, according to an embodiment of the invention. As shown in FIG. 5, the modular package structure 505 comprises a base (standardized) package substrate 510 and an RFIC chip 102 flip-chip mounted to the base package substrate 510. In the exemplary embodiment of FIG. 5, the base package substrate 510 comprises an interface layer 130 and a core layer 120, which are structurally the same as the interface and core layers shown in FIG. 1. In addition, a multilayer structure 540 (or interface layer 540) is formed on the core layer 120. The multilayer structure 540 comprises first and second layers L1 and L2, which are similar in structure to the layers L1 and L2 of the antenna layer 140 shown in FIG. 1.

The connector package 542 comprises a plurality of build-up layers L3, L4, L5, and L6 comprising respective metallization layers M3, M4, M5 and M6, and dielectric layers D3, D4, D5, and D6. The connector package 542 comprises first and second connectors 544-1 and 544-2 formed on a first surface 542-1 of the connector package 542. The first and second connectors 544-1 and 544-2 may be implemented using, for example, coaxial connectors or waveguide interfaces. In addition, the connector package 542 comprises first and second feed lines 546-1 and 546-2 which are routed through the connector package 542 from a second surface 542-2 of the connector package 542 to the respective first and second connectors 544-1 and 544-2 on the first surface 542-1 of the connector package 542.

The first and second feed lines 546-1 and 546-2 are configured to connect the first and second connectors 544-1 and 544-2 of the connector package 542 to end portions of the first and second antenna feed lines 112 and 114, respectively, which are exposed on the metallization layer M2 of the interface layer 540. The metallization that forms the lateral portions of the first and second feed lines 546-1 and 546-2 (e.g., the metallization layer M4 of layer L4 of the connector package 542) is patterned to provide proper lateral routing and impedance matching for the first and second connectors 544-1 and 544-2.

The connectorized package structure 500 is formed by bonding the connector package 542 to the base package substrate 510 in proper alignment, as indicated by the double ended arrows shown in FIG. 5. The connector package 542 and the interface layer 540 collectively form an interface layer with complete package features when bonded together. For example, the connector package 542 and the interface layer 540 comprise metallic features which form an isolation region (similar to the isolation region 144 which is formed by the grounded vertical cavity wall 146 as shown in FIG. 1) when the connector package 542 and the interface layer 540 are bonded together.

The connectorized package structure 500 can be used, for example, to evaluate the performance of the RFIC chip 102, or to evaluate the performance of antenna feed lines and interface structures within the base package substrate 510. In this regard, external test equipment, package structures, or external antenna systems, etc., can be coupled to the connectorized package structure 500 using the first and second connectors 544-1 and 544-2. In particular, an external antenna array system can be connected to the connectorized package structure 500 and controlled by the transceiver circuitry on the RFIC chip 102.

For ease of illustration, the exemplary connectorized package structure 500 of FIG. 5 illustrates one pair of connectors 544-1/544-2 and corresponding feed lines 546-1/546-2. However, in other embodiments of the invention, for antenna array systems as discussed herein, the connector package 542 can be fabricated with multiple pairs of connectors and associated feed lines, which are configured to interface with a modular package structure having multiple pairs of antenna feed lines and multiple RFIC chips. In this regard, a connectorized package structure with multiple RFIC chips can be fabricated to interface with an external phased array antenna system, for example, which is controlled by the RFIC chips.

Figure 6A:
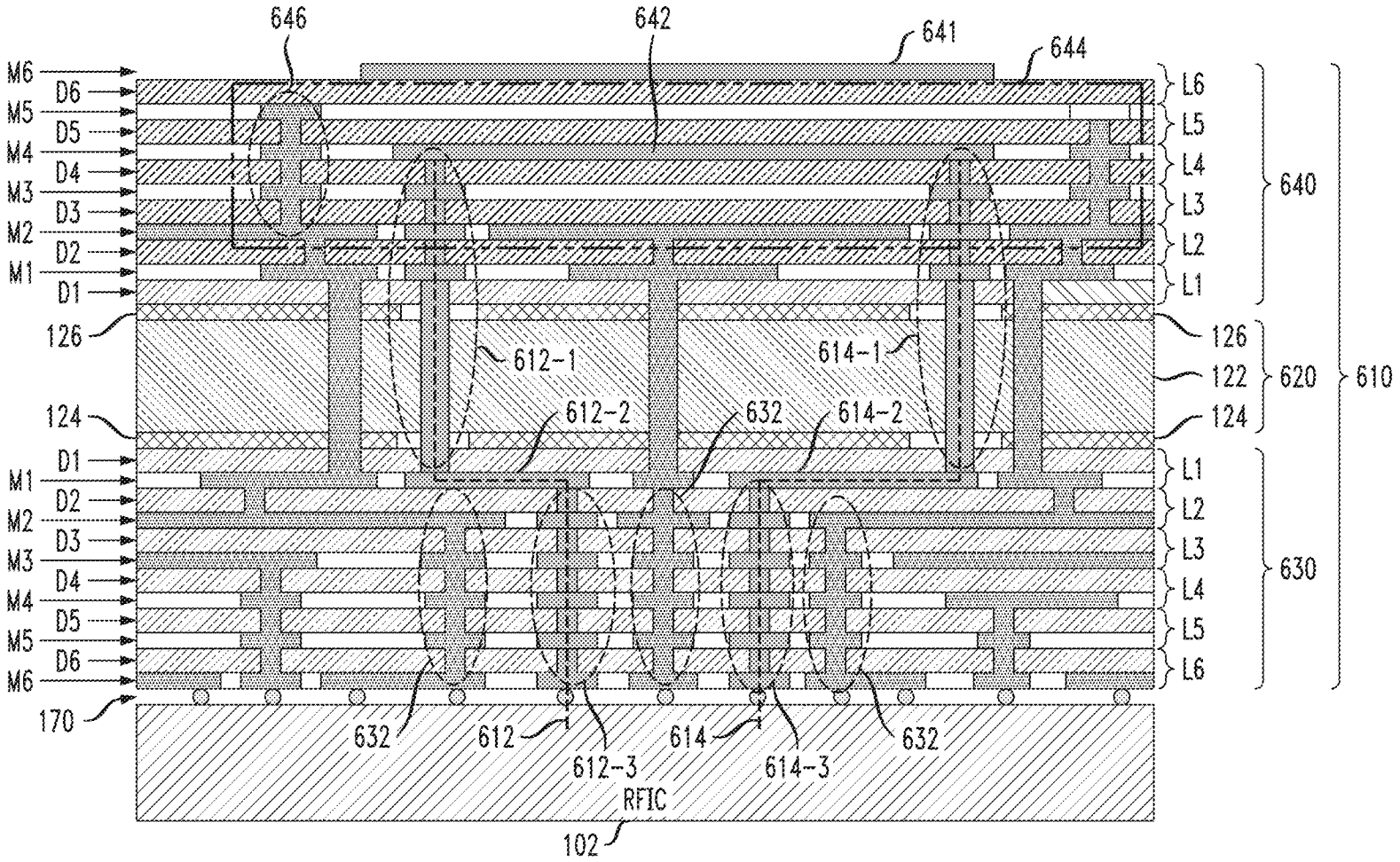
FIGS. 6A and 6B schematically illustrate a wireless communications package according to yet another embodiment of the invention.
Figure 6B:
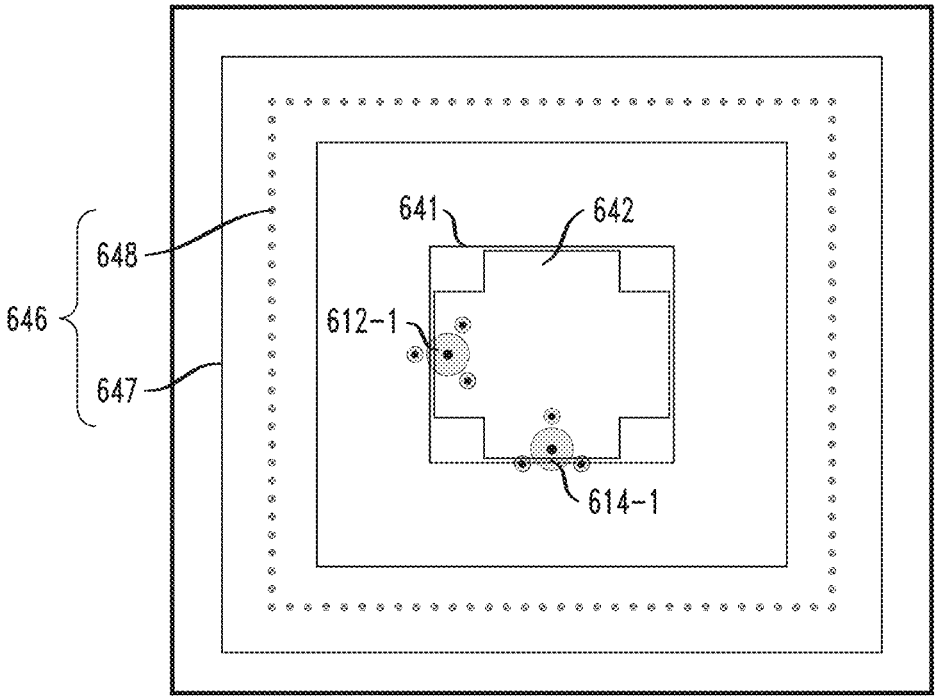

FIGS. 6A and 6B schematically illustrate a wireless communications package according to yet another embodiment of the invention. In particular, FIG. 6A is a schematic cross-sectional side view of a wireless communications package 600 comprising an antenna package 610 coupled to an RFIC chip 102. The antenna package 610 comprises a multilayer substrate structure comprising a central core layer 620, an interface layer 630, and an antenna layer 640. The central core layer 620, the interface layer 630, and the antenna layer 640 implement various features similar to the central core layer 120, the interface layer 130, and the antenna layer 140 discussed above with reference to the example embodiment of FIG. 1. However, the embodiment of FIG. 6A does not utilize a package cover and an embedded air cavity as the wireless communications package 100 of FIG. 1. Instead, the antenna elements are fabricated as part of metallization layers of the antenna layer 640.

In particular, as shown in FIG. 6A, the antenna package 610 comprises a first antenna feed line (denoted by dashed line 612) to implement a horizontal polarization mode of antenna operation, and a second antenna feed line (denoted by dashed line 614) to implement a vertical polarization mode of antenna operation. The first and second antenna feed lines 612 and 614 are routed through the interface layer 630, the core layer 620, and the antenna layer 640, wherein the first and second antenna feed lines 612 and 614 comprises respective vertical portions 612-1 and 614-1, horizontal portions 612-2 and 614-2, and vertical portions 612-3 and 614-3.

In particular, as shown in FIG. 6A, the vertical portions 612-3 and 614-3 of the first and second antenna feed lines 612 and 614 extend through the interface layer 630, and are shielded by vertical shielding structures 632, effectively forming coaxial transmission lines as discussed above with reference to FIG. 1. In addition, in the example embodiment of FIG. 6A, the horizontal portions 612-2 and 614-2 of the first and second antenna feed lines 612 and 614 are patterned in the metallization layer M1 of the first layer L1 of the interface layer 630. The horizontal portions 612-2 and 614-2 are designed to adjust the length of the antenna feed lines 612 and 614 and thereby provide equalized feed line lengths using, for example, the methods discussed above with reference to FIGS. 2A and 2B.

Furthermore, the vertical portions 612-1 and 614-1 of the first and second antenna feed lines 612 and 614 extend from the interface layer 630 through the core layer 620 and into the antenna layer 640 to feed a stacked patch antenna structure 641/642. The stacked patch antenna structure 641/642 comprises a feed patch element 642 patterned on the metallization layer M4 of the antenna layer 640, and a patch antenna radiator element 641 patterned on the metallization layer M6 of the antenna layer 640. The vertical portions 612-1 and 614-1 of the first and second feed lines 612 and 614 are connected to different points on the feed patch element 642 to enable dual-polarized operation. The feed patch element 642 is configured to couple RF energy to and from the patch antenna radiator element 641 using known antenna design techniques.

As further shown in FIG. 6A, an isolation region 644 is formed by a vertical cavity wall 646 (which surrounds the stacked patch antenna structure 641/642) and a lower ground plane formed on the metallization layer M2. The isolation region 644 serves to improve the radiation efficiency of the stacked patch antenna structure 641/642, and reduces EM coupling between adjacent stacked patch antenna structures of an array of stacked patch antenna structures formed on the upper surface of the antenna layer 640.

FIG. 6B schematically illustrates a top plan view of the stacked patch antenna structure 641/642 and the surrounding vertical cavity wall 646. As shown in FIG. 6B, the feed patch element 642, which is patterned on the metallization layer M4 of the antenna layer 640, comprises a cross-shaped pattern (e.g., a rectangular shape with its corners cut out). The patch antenna radiator element 641, which is formed on the metallization layer M6 of the antenna layer 640, comprises a footprint area that is aligned to the underlying feed patch element 642. As further shown in FIG. 6B, the vertical portions 612-1 and 614-1 of the first and second antenna feed lines 612 and 614 are connected to different sides of the feed patch element 642 to enable a dual-polarized mode of operation of the stacked patch antenna structure 641/642.

As further shown in FIG. 6B, the vertical cavity wall 646 surrounds the stacked patch antenna structure 641/642. The vertical cavity wall 646 comprises a stack of metallic rectangular rings 647 and vertical vias 648. The stack of metallic rectangular rings 647 comprises metallic features that are patterned from, e.g., metallization layers M3, M4, and M5 of the antenna layer 640 (FIG. 6A). The vertical vias 648 comprise a series of metallic vias that are formed in the dielectric layers D3, D4, and D5 of the antenna layer 640 (FIG. 6A) to connect the stack of metallic rectangular rings 647 together across the layers L3, L4 and L5 of the antenna layer 640, to ground the vertical cavity wall 646 to the underlying ground plane on the metallization layer M2 of the antenna layer 640.

For ease of illustration, the exemplary wireless communications package 600 of FIGS. 6A and 6B is shown with one stacked patch antenna structure 641/642 and corresponding antenna feedlines 612 and 614 which enable a dual polarization mode of operation of the stacked patch antenna structure 641/642. However, the wireless communication package 600 can be fabricated to have (i) an array of stacked patch antenna structure 641/642 and associated feed line pairs connected to one or more RFIC chips, and (ii) dummy stacked patch structures with associated resistive transmission lines that are terminated in the metallization layer M5 of the interface layer 630, using the same or similar techniques as discussed above with reference to FIGS. 3A and 3B, for example.

Those of ordinary skill in the art will readily appreciate the various advantages associated with integrated chip/antenna package structures according to embodiments of the invention. For instance, the package structure can be readily fabricated using known manufacturing and packaging techniques to fabricate and package antenna structures with semiconductor RFIC chips to form compact integrated radio/wireless communications systems that are configured to operate at millimeter-wave frequencies and higher. Moreover, integrated chip packages according to embodiments of the invention enable antennas to be integrally packaged with IC chips such as transceiver chips, which provide compact designs with very low loss between the transceiver and the antenna. Various types of antenna designs can be implemented including patch antennas, slot antennas, slot ring antennas, dipole antennas, and cavity antennas, for example. Moreover, the use of integrated antenna/IC chip packages according to embodiments of the invention as discussed herein saves significant space, size, cost, and weight, which is a premium for virtually any commercial or military application.

Although embodiments have been described herein with reference to the accompanying drawings for purposes of illustration, it is to be understood that embodiments of the invention are not limited to those precise embodiments, and that various other changes and modifications may be affected herein by one skilled in the art without departing from the scope of the invention.

We claim:

1. An antenna package, comprising:

a multilayer package substrate comprising a plurality of laminated layers, each laminated layer comprising a patterned metallization layer formed on an insulating layer;

wherein the multilayer package further comprises:

a planar antenna array which comprises an array of active antenna elements and a plurality of dummy antenna elements disposed around an entire outer perimeter of the array of active antenna elements;

a plurality of antenna feed lines, wherein each active antenna element is coupled to a corresponding one of the antenna feed lines; and a plurality of resistive transmission lines, wherein each dummy antenna element is coupled to a corresponding one of the resistive transmission lines;

wherein each resistive transmission line extends through the multilayer package substrate and is grounded in a same metallization layer of the multilayer package substrate to thereby terminate radiation incident on the dummy antenna elements.

2. The antenna package of claim 1, wherein the multilayer package substrate comprises:

a planar core layer comprising a core substrate, and first and second ground planes formed on first and second surfaces of the core substrate;

an antenna layer bonded to the first ground plane of the core substrate, wherein the antenna layer comprises multiple laminated layers of the plurality of laminated layers, wherein the antenna layer comprises one or more antenna ground planes, wherein end portions of the antenna feed lines in the antenna layer are aligned to, and electromagnetically coupled to, respective active antenna elements of the array of active antenna elements, and wherein end portions of the resistive transmission lines in the antenna layer are aligned to, and electromagnetically coupled to, respective dummy antenna elements of the plurality of dummy antenna elements; and an interface layer bonded to the second ground plane of the core substrate, wherein the interface layer comprises multiple laminated layers of the plurality of laminated layers, wherein the interface layer comprises a power plane, a ground plane, and signal lines formed on one or more patterned metallization layers of the interface layer.

3. The antenna package of claim 1, wherein each antenna feed line comprises a first antenna feed line and a second antenna feed line, wherein the first and second antenna feed lines of the respective active antenna elements enable a dual polarization mode of operation of the active antenna elements, and wherein each resistive transmission line comprises a first resistive transmission line and a second resistive transmission line, wherein the first and second resistive transmission lines of the respective dummy antenna elements are configured to terminate dual polarized radiation incident on the dummy antenna elements.

4. The antenna package of claim 1, wherein:

the active antenna elements and the dummy antenna elements each comprise a stacked patch structure;

the stacked patch structures of the respective active antenna elements each comprise a feed patch element, and a patch antenna element which is electromagnetically coupled to the feed patch element, wherein the antenna feed lines of the respective active antenna elements are connected to corresponding ones of the feed patch elements of the active antenna elements; and the stacked patch structures of the respective dummy antenna elements each comprise a feed patch element, and a dummy patch antenna element which is electromagnetically coupled to the feed patch element, wherein the resistive transmission lines of the respective dummy antenna elements are connected to corresponding ones of the feed patch elements of the dummy antenna elements.

5. The antenna package of claim 4, wherein the multilayer package substrate comprises a plurality of isolation structures, wherein each isolation structure comprises a series of metallization traces and conductive vias formed within multiple laminated layers of the multilayer package substrate, wherein each isolation structure is configured to surround a corresponding one of the feed patch elements of the active antenna elements and the dummy antenna elements.

6. The antenna package of claim 1, wherein the antenna feed lines have equalized lengths.

7. The antenna package of claim 6, wherein a lateral routing of the antenna feed lines within the multilayer package substrate is implemented with transmission lines formed in a same metallization layer of the multilayer package substrate, wherein the lateral routing of the antenna feed lines is configured to equalize the lengths of the antenna feed lines.

8. The antenna package of claim 7, wherein the transmission lines for the lateral routing of the antenna feed lines comprise coplanar waveguide transmission lines.

9. The antenna package of claim 1, further comprising a ground plane formed on a surface of the multilayer package substrate, wherein the ground plane is configured to provide electromagnetic shielding between the multilayer package substrate and a RFIC (radio frequency integrated circuit) chip that is flip-chip bonded to the surface of the multilayer package substrate.

10. The antenna package of claim 9, further comprising a plurality of RFIC chips, wherein each RFIC chip is flip-chip bonded to the surface of the multilayer package substrate, wherein the ground plane formed on the surface of the multiplayer package substrate comprises a plurality of via openings to provide contact ports for connections between the RFIC chips and package feed lines, signal lines and power lines formed within the multilayer package substrate.

11. The antenna package of claim 1, wherein the active antenna elements and the dummy antenna elements comprise patch antenna elements.

* * * * *